United States Patent [19]

Stevens

[11] Patent Number: 4,684,850

[45] Date of Patent: Aug. 4, 1987

[54] VARIABLE FREQUENCY BRIDGE INVERTER FOR DRIVING GAS DISCHARGE LAMPS

[76] Inventor: Carlile R. Stevens, 468 El Rio Rd., Danville, Calif. 94526

[21] Appl. No.: 778,922

[22] Filed: Sep. 23, 1985

[51] Int. Cl.[4] ..... H05B 37/02

[52] U.S. Cl. ..... 315/209 R; 315/222; 315/226; 315/DIG. 7

[58] Field of Search ..... 315/DIG. 7, 307, 244, 315/209 R, 226, 222

[56] References Cited

U.S. PATENT DOCUMENTS

| | | | |
|---|---|---|---|
| 3,753,071 | 8/1973 | Engel et al. | 315/DIG. 7 |
| 4,045,711 | 8/1977 | Pitel | 315/209 R |
| 4,370,600 | 1/1983 | Zansky | 315/244 |
| 4,471,269 | 9/1984 | Ganser et al. | 315/307 |

*Primary Examiner*—Harold Dixon

*Attorney, Agent, or Firm*—Roger A. Marrs

[57] ABSTRACT

A solid state bridge inverter is disclosed wherein the power for driving the transistors is generated by the current flowing to the load. Windings are so connected on the drive transformers that one transistor cannot possibly turn on until the other one is fully off including storage and turn off time. This is accomplished in such a manner that the load may be highly inductive without any detrimental effect upon the power transistors. Also disclosed is a unique method for deriving the power for the logic circuitry as well as a concept where a single magnetic element can provide both a balun type filter action on the input as well as power factor correction and smoothing action to supply filtered DC voltage and current to the inverter while maintaining a 0.9+ power factor to the AC line. Further disclosed is a combination of the above described components along with further unique circuit configurations to provide a highly efficient solid state fluorescent ballast.

12 Claims, 7 Drawing Figures

FIG. 1
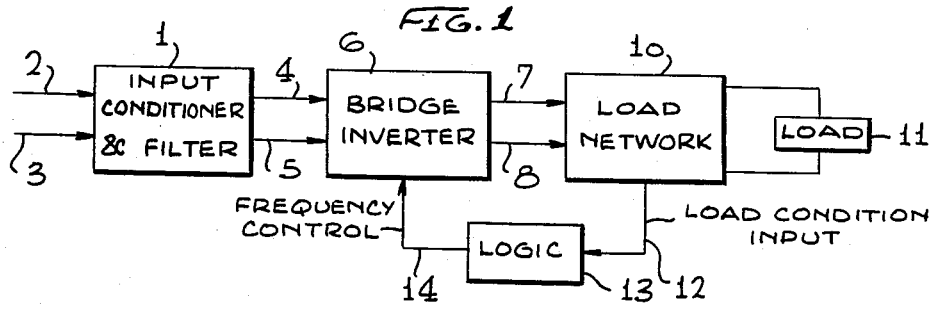
FIG. 2
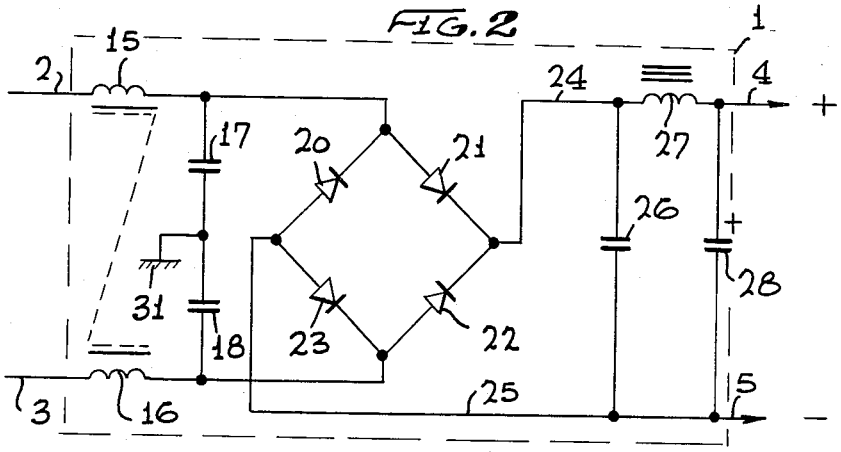
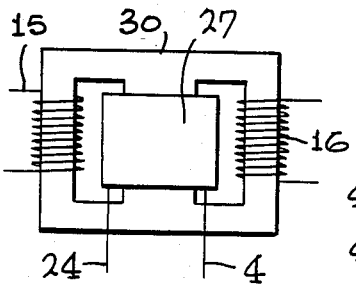
FIG. 3
FIG. 4
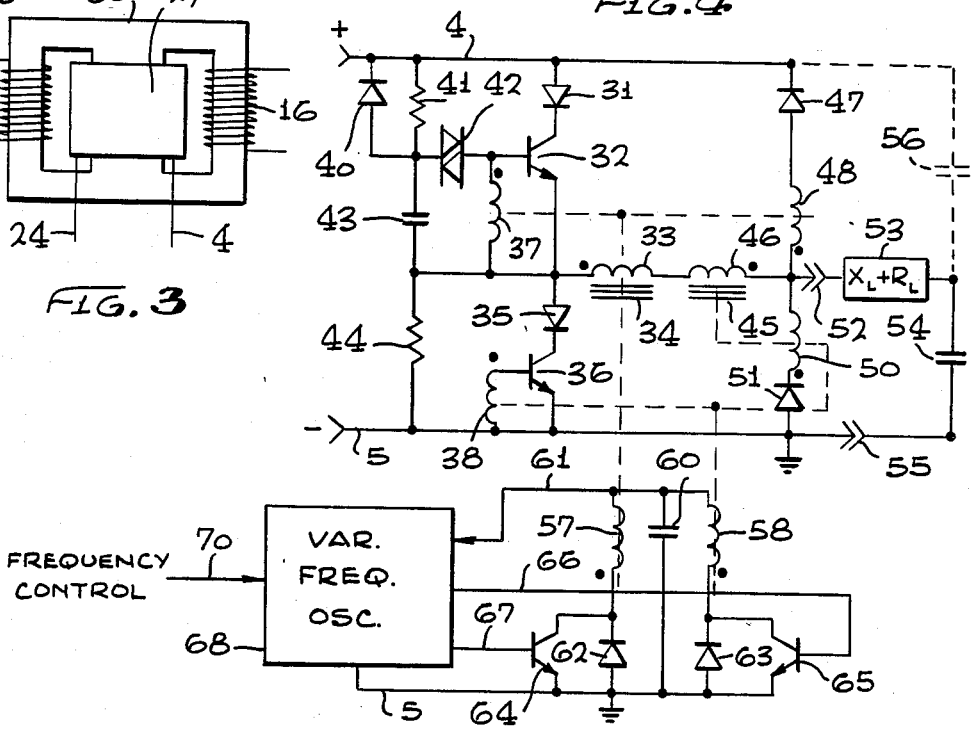

VARIABLE FREQUENCY BRIDGE INVERTER FOR DRIVING GAS DISCHARGE LAMPS

BACKGROUND OF THE INVENTION

1. Field of the Invention

The present invention relates to a power switching inverter in a half bridge configuration that supplies high frequency AC power into a highly inductive load. This is done with a minimum number of components and almost nonexistent logic power in such a manner that the energy to turn off and on the power transistors is supplied proportional to the current flowing through them. The invention also relates to a simple method to draw the power from the line at a high power factor. The most significant application of this circuit is for a high frequency electronic dimming ballast for fluorescent tubes and other forms of gas discharge devices that are used to produce light either directly or indirectly. The concept also has value in the power inverter field for the generation of ultrasonic drive power used in industry for cleaning and welding and in medicine for many applications.

2. Brief Description of the Prior Art

Bridge inverters have been around for some time. Normally the power transistors are driven, either directly or through some form of base drive transformer. In this manner, the logic circuitry is able to create an adequate deadband to allow one transistor to turn off before the second one turns on. In the event an inductive load is to be driven, a pair of diodes are connected across the two transistors (one diode across the emitter collector of each transistor) in order to handle the currents that flow as a result of the inductive load when the transistors are driven out of phase. This method of drive control depends upon the transistor specification such that it will turn off within the time alloted for it to do so.

Utilizing a base drive transformer with the primary in series with the load current has been another practical method of reducing drive energy while properly driving the power transistor. However, this method of self drive requires that the load be resonant and the operating frequency is fixed by the resonant frequency of the load. Thus, up to now there has not been a method of utilizing the current delivered to the load as the source of drive power for the drive transistor while creating a variable frequency drive with the appropriate protection to prevent one transistor from coming on before the other one has completely turned off.

Practically all electric devices other than those used on transportation equipment or solar powered systems draw their energy from the AC power line. The supply voltage may vary depending upon the application and country, from around 100 up to 480 volts. The frequency will be either 50 or 60 Hertz. In order to operate a high frequency inverter I must first convert the input line power to direct current and filter it so that the circuit will not be subjected to a high degree of line frequency ripple. Unfortunately simple rectifying of the power line and filtering with a large capacitor produces a high degree of power line distortion normally characterized as poor power factor. Although this has not been a significant problem in the past because only a small amount of electric equipment used rectification compared to the total load, this problem is rapidly changing with the installation of large computer systems, computer terminals at every desk, and now solid state electronic lighting systems. By choosing the appropriate capacitor inductor network at the output of the conventional bridge rectifier, this problem may be solved and the power factor brought to 0.9+. It is also necessary to protect the diodes in the bridge rectifier from power line transients that can create voltages higher than the rate of blocking voltage of the bridge diode. In addition, noise generated within the inverter power supply circuit must be kept off the power line. It is the normal practice to install a balun type of transformer configuration on the two input leads. This than requires two magnetic elements in the input circuitry, the input baluns just described and the power factor correction inductor. As a further point in the prior art, any form of frequency control in the past utilizing a separate transistor drive has had to have a power supply of some nature associated with it in order to supply adequate power to drive the transistors. The amount required to do this has a substantial negative impact on the circuit's efficiency as well as requiring additional components. Present solid state electronic ballasts, although more efficient than the old style core and coil types are still too expensive and/or complex to be competitive in today's market.

SUMMARY OF THE INVENTION

Accordingly, the above problems and difficulties are obviated by the present invention which provides that the power for driving the transistors be derived as a result of the current flowing through them while maintaining an extremely low energy frequency control circuit such that the power consumed by the control circuit will be unnoticed in the efficiency calculations. The present invention also allows that the transistor drive be tailored directly such that the base current will always be a fixed percentage of the collector current so that additional base power is never consumed when not needed. Relative to the input circuit, the present invention utilizes a single magnetic element to provide both the balun action as well as the power factor correction reducing cost and complexity and improving circuit performance. The present invention also provides that the less expensive power transistors may be employed for the same power handling capability. The fluorescent ballast configuration takes advantage of these cost savings and reliability improvements while using the ability to vary frequency to provide a dimming feature. Special circuitry is also incorporated to control heater power while starting and dimming.

OBJECT OF THE INVENTION

It is among the primary objects of this invention to provide a high frequency inverter drive into a substantially inductive load without the drive being dependent upon the resonant characteristics of such load.

It is another object of this invention to accomplish this at a very high efficiency assuring that the least amount of power is consumed to reliably drive the switching transistors.

Still another object of the invention is to adjust the drive to those transistors in such a manner that the base current shall be directly proportional to the collector current at all values of collector current.

A further object of the invention is to minimize the number of electronic components required to produce the end result while increasing reliability and efficiency.

A still further object of the invention is to provide a highly efficient electronic adjustable output (dimming) fluorescent ballast.

A final object of the invention is to be able to construct the invention from readily available economical electronic components.

BRIEF DESCRIPTION OF THE DRAWINGS

The features of the present invention which are believed to be novel, are set forth with particularity in the appended claims. The present invention both as to its organization and manner of operation together with further objects and advantages thereof may be best understood by referring to the following description taken in connection with the accompanying drawings, in which:

FIG. 1 is a block diagram of a typical application in which the present invention may be applied;

FIG. 2 is a schematic representation of the input circuitry converting the AC line power to filtered DC power current.

FIG. 3 is a pictorial version of the magnetic element's three windings which are depicted in FIG. 2;

FIG. 4 is a schematic representation of the novel drive circuitry depicting the interconnection between the drive transformers, the oscillator and the output inductive load;

DESCRIPTION OF THE PREFERRED EMBODIMENTS

The following detailed descriptions of are the best presently contemplated modes of carrying out the invention. This description is not to be taken in a limiting sense but is made merely for the purpose of illustrating the general principles of the invention since the scope of the invention is best described in the appended claims.

Figure 6:
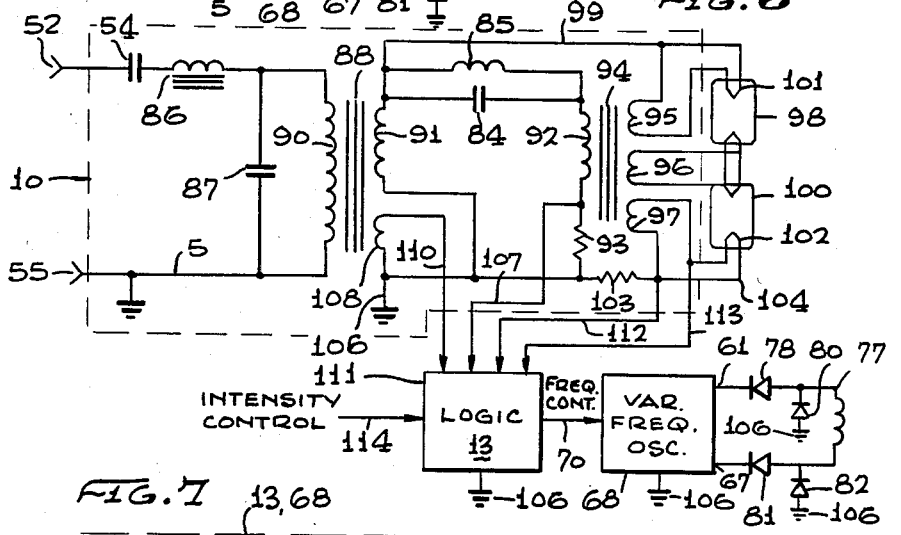
FIG. 6 depicts a novel output circuit to be connected as the load of either circuits described in FIGS. 4 or 5. This circuit shows an output circuit for driving two fluorescent tubes and allowing for adjustable frequency for dimming action and heater power control.
Figure 7:
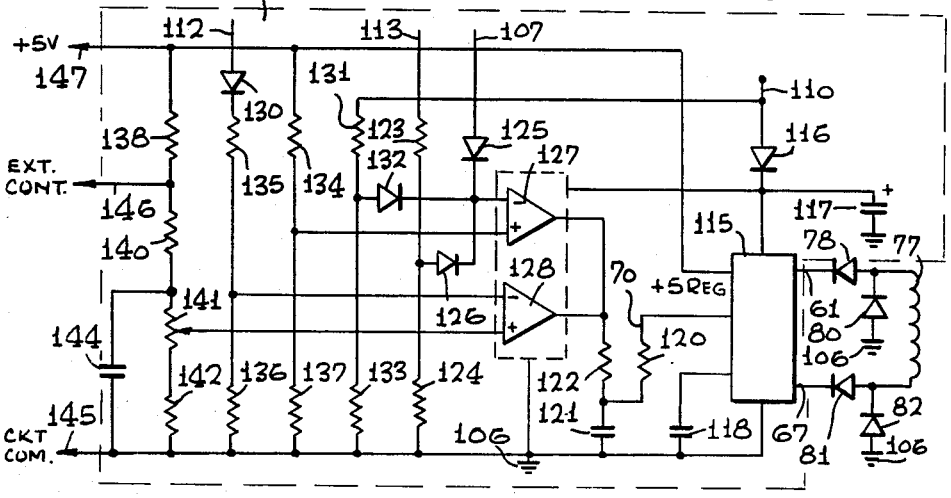
FIG. 7 is a more detailed schematic representation of the areas shown in FIG. 6 as 'logic' and 'variable frequency oscillator'.

Referring to FIG. 1, the block diagram shows an input conditioner and filter 1 receiving its power from the line input 2 and 3 and supplying the power on the supply (+) and common (−) lines 4 and 5 respectively to the bridge inverter 6. In most applications for which this present invention will be employed, there is a need to gather information from the load network and to control the power delivered by adjusting the frequency of the output of the bridge inverter. The application for driving fluorescent tubes for lighting purposes is shown in FIGS. 6 and 7 and will be discussed subsequently. The output is therefore fed from the bridge inverter 6 to the load network 10 via lines 7 and 8 and the power is processed by said network and delivered to load 11. Data concerning the voltage and current in load 11 is collected from the load network and presented to logic network 13 via line 12. The output of the logic network is used to control the frequency of the bridge inverter through the interconnect line 14.

Each element is discussed individually starting discussing first with the input conditioner and filter 1 as depicted in FIG. 2. The AC line power enters on lines 2 and 3 and is passed through windings 15 and 16 of the magnetic element 30 to present the line power to the bridge rectifier comprised of diodes 20, 21, 22 and 23. Capacitors 17 and 18 are connected in series across the input to the bridge rectifier. The center of the two capacitors is connected to earth or chassis ground 31. The action of the capacitor 17 and 18 as well as windings 15 and 16 protect the bridge rectifier diodes from line transients. They also serve to reduce the conducted EMI back onto the power line. Capacitors 26 and 28 and winding 27 of magnetic element 30 comprises the network to maintain the power factor above the 0.9 level. Capacitor 28 is selected to be large enough to supply the filtering required such that the ripple on the DC voltage across lines 4 and 5 is adequately reduced while the value of capacitor 26 is small enough that inrush currents are relatively insignificant and the output of the bridge at the junctions of diodes 21 and 22 effectively track the input line voltage as to its amplitude.

Referring now to FIG. 3 it can be seen that the configuration of the magnetic element 30 upon which windings 15, 16, and 27 are located. Coils 15 and 16 are placed on the outside legs of a typical EI or EE silicon iron laminate configuration with the main large winding 27 wound on the center post. This allows the maximum inductance for winding 27 which is necessary to accomplish the end result with the smaller inductances on the two outside edges. Also by mounting them in this manner, they function both in the balun configuration as well as inductors for elimination of all modes of potential interference. The high leakage reactance of the center pole allows the two outside windings to function as inductors as well as allows for some coupling for balun performance. The two outside windings are polarized such that the fields cancel in the center so their action will not effect the operation of the center winding. The combining of all these windings on a single core achieves substantial cost savings.

Referring now to FIG. 4 a schematic representation of the functional bridge inverter with transistors 32 and 36 performing the half bridge switching is shown. The unit is triggered into action by the firing of diac 42 after capacitor 43 has been charged through the resistor path comprising 41 and 44 from the supply line 4 to the common line 5. Diode 40 serves to keep capacitor 43 discharged while the circuit is running preventing any further pulses from diac 42. When transistor 32 is triggered on, collector current flows from the supply line 4 through diode 31, the collector emitter junction of transistor 32, through winding 33 of base drive transformer 34, winding 46 of the second base drive transformer 45, to the load 53 through connection point 52, capacitor 54 and point 55 to the common line 5. As current flows through winding 33 of transformer 34 the windings are polarized, as indicated by the dots, such that a positive current will flow in winding 37 of the same transformer to maintain transistor 32 in the on condition. The turns ratio between windings 33 and 37 is set at or below the minimum expected operating beta or gain of transistor 32. Thus as the collector current of transistor 32 increases the base drive current will increase proportionately. While this current is flowing, the current through winding 46 of transformer 45 maintains a negative voltage on the base of transistor 36 via winding 38 of transformer 45.

As shown in the lower section of the figure, winding 58 of transformer 45 is so polarized that current flows through diode 63 to charge capacitor 60 and supply power to the variable frequency oscillator via line 61. The turns ratio between winding 46 and winding 58 is such that although only a few millivolts appear across winding 46, winding 58 will develop approximately 20 volts to charge capacitor 60. The same ratio is maintained between windings 33 and 57 of transformer 34. At the end of the first one-half cycle of the free running variable oscillator 68, transistor 64 will be turned on via line 67. This serves to connect the now positive end of winding 57 to common 5. The negative potential impressed across this winding 57 produces a negative potential on the other windings of transformer 34; most specifically winding 37 connected to the base of transistor 32. This drives transistor 32 into the off condition. Current will continue to flow through 32 until the storage time has elapsed and the transistor turns off. However, since the load is inductive, the current will lag the drive and will have to continue to flow. Since it cannot flow through transistor 32, it will now flow through diode 51 and winding 50 of transformer 45 to the load. The current flowing through winding 50 of transformer 45 will turn on transistor 36 via winding 38 even though there is no positive bias on its collector. Thus it will be ready to accept current as soon as it is reversed by the inductive load. By turning on the transistor at this time there are no on switching losses in the circuit. Diode 35 must be added to prevent the positive voltage from winding 38 to cause current to flow through the base-collector junction of transistor 36 into windings 33 and 46 of the drive transformers.

As soon as the current in the load reverses it will flow from common line 5 through connection point 55, DC isolation capacitor 54, inductive and resistive load 53, transformer 45 through winding 46, transformer 34 through winding 33, diode 35 and transistor 36. Because of the DC isolation capacitor 54, the load swings around the midpoint between the supply voltage and common. Thus all of the current that flows through the load into capacitor 54 must flow back out of capacitor 54, through the load 53 and through transistor 36. As it flows through the two windings 46 and 33 of transformers 45 and 34 respectively, the opposite occurs as with the previous half cycle. The current through winding 33 produces a negative voltage at the base of transistor 32 via the action of winding 37. A positive voltage is produced by the action of transformer 45 at the base of transistor 36 via winding 38 biasing it on. The turns ratio of windings 46 and 38 again is in the same proportion as the transistor's gain to maintain the maximum efficiency of the drive.

During this time, winding 57 of transformer 34 is so biased as to recharge capacitor 60 through the action of current flowing through diode 62. Again, when the oscillator times the end of the next one half cycle, transistor 65 will be turned on biasing off transistor 36 by the negative voltage now supplied by winding 38. Since the load wants to maintain the current flow in the same direction, current will now flow through winding 48 of transformer 34, diode 47 back to the supply line 4. This will hold transistor 32 on via the action of windings 37 until the load reverses current and draws power through diode 31 and transistor 32, thus starting the cycle over again. As can be seen, the only power needed in the oscillator circuitry is that required to drive the variable frequency oscillator 68 itself and its outputs. That power is derived from the transformer action of transformer 34 and 45 used to charge capacitor 60 through windings 57 and 58 as described. On transfomers 33 and 46 windings 34, 45, 48, and 50 function as drive or primary windings. Windings 37 and 38 function as secondaries. Windings 57 and 58 function as both, primaries to turn off the transistor 32 and 36 and secondaries to charge capacitor 60. If the oscillator is constructed of conventional CMOS components this power is almost nonexistent. Enough output must be available to drive transistors 64 and 65 on when required. Since the collector currents are very small because of the high turns ratio of windings 57 and 58 to the other windings of their transformers, coupled with the gain of transistors 64 and 65, a very small amount of drive current is required compared to the current being handled by the inverter.

Figure 5:
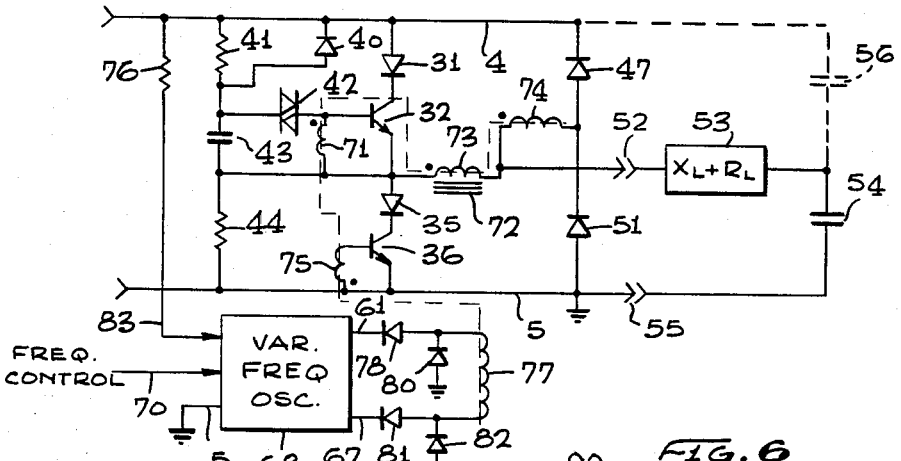
FIG. 5 is a simpler version of the circuit as shown in FIG. 4 and is the most likely implementation for load of medium power applications.

FIG. 5 is a simpler configuration of the same type of circuit but uses only one drive transformer 72. This circuit is simpler to implement but does not have the negative transistor turn off characteristics as shown in the circuit of FIG. 4. Once transistor 32 has been initiated into conduction in the same manner as described in description of FIG. 4, current flows through diode 31 from the supply line 4, transistor 32, winding 73 of transformer 72, to the load 53, through interconnect point 52, DC isolation capacitor 54, and common interconnect 55. This current flowing through winding 73 causes a voltage and current to be induced in winding 71 that drives and maintains transistor 32 in the on condition. Again the turns ratio between winding 73 and 71 is adjusted to equal the minimum gain requirement for the maximum current used by the circuit. At the appropriate time the variable frequency oscillator effectively shorts winding 77, via the action of diode 82 and 78 or 81 and 80 respectively, depending upon which half cycle, through the interconnect point 61 or 67 to the oscillator. When this winding is shorted, all windings of transformer 72 are effectively shorted. This causes transistor 32 to turn off after the appropriate storage time has elapsed. As soon as 32 is off, current must still flow into the inductive load via diode 51 and winding 74 of the drive transformer. Since this is a reverse current in the transformer the shorting action of the oscillator is not effected since it is applied to the other polarity. At this time transistor 36 is turned on via the action of winding 75. This action also holds off transistor 32. When the load current does reverse, it now flows back through winding 73 diode 35, and transistor 36 to the common 5. Since very small power is required for the oscillator again because of the high turns ratio of winding 77 to the other windings it may be supplied through dropping resistor 76. Although this is not the most efficient way to supply power, the amount needed is small enough that the loss is not significant. As an alternative, the power may be supplied from the load side as shown in the FIG. 6 configuration.

FIG. 6 depicts a load for this particular kind of circuit wherein variable high frequency is required in this small efficient configuration. Loads 98 and 100 are two fluorescent tubes which are to be lit and dimmed in response to an intensity control. The circuit must take several things into consideration regarding driving the fluorescent tubes, thus the need for the variable frequency.

First, the heaters must be brought up to temperature before striking the tubes. If the tubes are struck too soon their life will be shortened. Secondly, once the tube is struck and illuminated at full intensity there is no need to continue to maintain heater power and for the sake of efficiency and energy savings they should be turned off. However, if the object is to dim the tubes, an increasing heater current must be supplied as tube current decreases to maintain the proper heater temperature or again, the life will be shortened. The circuit of FIG. 6 along with the operation of the logic as depicted in FIG. 7 accomplishes this result. When power is first supplied to the circuit, the alternating output of the bridge inverter is applied through the DC isolation capacitor 54 from the interconnect point 52 to inductor 86. Since the starting frequency is high the impedance of inductor 86 is high and the impedance of capacitor 87 is low resulting in a low voltage being applied to the primary 90 of transformer 88. Since this is a low voltage it will not be able to strike the tube which is connected across the secondary 91 of the same transformer. The two tubes, 98 and 100, connected in series are connected between line 99 to the heater end 101 of tube 98 and through resistor 103 to heater end 102 of tube 100.

Since the frequency is high, parallel resonant circuit 84 and 85 will be detuned and primarily capacitive allowing full conduction of power to the primary 92 of heater transformer 94. The power fed to heaters is measured by the voltage drop across resistor 93 in series with the primary 92 and the sense line 107 supplies this information to the logic to prevent the heater current from going too high. The heaters are tungsten and therefore have a cold resistance less than 1/10 that for normal operation. Thus the line 107 adjusts the frequency to prevent too much heater power from being drawn. If one of the tubes should be taken out of the socket, the voltage across 92 could increase such that an overvoltage could be presented to the two heaters in the remaining tubes. To prevent this a feedback is taken from the output of winding 97 through line 113 to the logic circuitry to hold the frequency at the point where the other heaters will not be damaged. As the frequency drops, power to the heaters will rise with the voltage increase at the junction of inductor 86 and capacitor 87. Once the heaters have reached their temperature, the frequency continues to drop until resonance of 86 and 87 is approached. This produces a high voltage at the primary 90 of transformer 88, reflected in the output winding 91 across the tubes, and causes them to strike. Once the tubes are lit at the frequency of full intensity, the parallel resonant circuit comprising inductor 85 and capacitor 84 is at resonance blocking current flow to heater transformer 94. The current passing through the load (tubes) flows through sense resistor 103 and the drop across it is supplied to the logic as a feedback enabling the logic to hold the frequency wherever necessary to maintain a prespecified current. The resistive load of the tubes is reflected back from the secondary to the primary of transformer 88 and lowers the Q of the resonant circuit 86 and 87 so that the appropriate voltage and current are maintained. The voltage will then be substantially less than striking voltage which also helps to reduce heater power.

To control the intensity of the tubes, logic input 114 sets the amount of current flowing through sense resistor 103. By raising the frequency the tube current may be reduced. The control from the logic adjusts the frequency of the variable frequency oscillator via line 70. There must also be a limitation on the maximum amount of voltage applied across the tubes to protect against situations where one tube is absent from the socket or totally nonfunctional. Winding 108 on transformer 88 supplies the power to the logic and the variable frequency oscillator as well, providing a voltage sense as to how much voltage is developed across transformer 88 secondary. Thus the frequency is not allowed to move into resonance far enough for this voltage to get above open circuit specifications. The variable frequency oscillator performs as described in FIGS. 4 and 5. Transformer 88 may be eliminated in those areas where output isolation from the line is not required. All of the logic, the heater transformer and the secondary of transformer 88 are connected to the load common 106 which is separated from the input common 5.

FIG. 7 describes the logic that occurs inside of logic block 111. This description must also refer to some elements of the other figures to be understood. The two main elements of the logic block 13 are integrated circuit 115 which is a standard inverter type integrated circuit (IC) containing an oscillator, a 5 volt regulator and two oppositely polarized outputs 61 and 67. There are a number of these standard chips on the market today. Silicon General IC No. 2 works in this application. The second integrated circuit is a dual comparitor shown as 127 and 128. When the circuits of FIG. 4 or FIG. 5 first start the current will flow from these circuits through inductor 86 to the primary of transformer 88. The second secondary winding 108 feeds this power via line 110 to the logic and oscillator circuits. This power is rectified by diode 116 and stored and filtered by capacitor 117. It is supplied to IC module 115 and serves to power this module as well as supply the internal 5 volt regulator which is used as a reference for the comparitor circuits. When power is first applied, capacitor 121 is totally discharged. This causes the oscillator to oscillate at its maximum frequency as determined by the values of resistor 120 and capacitor 118. The frequency starts to move down as capacitor 121 charges through the action of the current flowing out of IC 115 through resistor 120. If the heater voltage gets too high, it is detected on line 113 and applied to the negative input of comparitor 127 through diode 126 and resistor string 123 and 124. The bias string setting the positive input from the 5 volts is created by resistors 134 and 137. If the heater voltage is too high, the output of this comparitor is driven low pulling charge from capacitor 121 and preventing the frequency from going any lower or even moving it back up if the increased heater voltage is sudden. Also if the heater current is too high, this information is fed via line 107 through diode 125 to the same point. Once the heaters have reached their temperature, the frequency will continue to drop until the supply voltage at 110 exceeds the point as set by resistor string 131 and 133 to create an input to comparitor 127 via diode 132. This prevents the voltage from going too high in the event there is no tube or tubes in the socket. Assuming that the tube in fact did strike, then the frequency will continue down until the current is sensed across resistor 103 to be high as desired. This voltage is supplied to resistor string 135 and 136 through diode 130 via line 112 and presents a voltage to the negative input of comparitor 128. The allowable load current is set by the position of potentiometer 141 determining where the positive input of comparitor 128 is to be set. This voltage therefore determines the tube current. When the tube is fully lit, the frequency is such that capacitor 84 and inductor 85 are in parallel resonance and heater current is not flowing. As dimming is required, the frequency moves up through the action of comparitor 128 removing charge from 121. As the frequency moves up, the parallel resonance circuit 84 and 85 becomes detuned and additional heater power commences to flow as is required for dimming action. This is helped by the fact that the voltage across the tubes goes up as they are dimmed. External control of the intensity may be achieved by controlling the voltage at input 146 which is fed from an external source. This may be a pulsing signal where the duty cycle will determine the actual voltage appearing on capacitor 144 at the junction of resistor 140 and potentiometer 141. Thus tube intensity may be controlled through a local potentiometer 141 or an external signal applied at 146. Load common 145 and five volts 147 are also supplied to the external circuitry to power whatever equipment might be needed to determine what intensity is desired.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A source of DC voltage;

a first transistor and a first diode connected in series such that said voltage source is applied to the collector of said first transistor through said first diode which is forward biased to conduct current through said first diode at the same time it is passing through said first transistor;

a second transistor and a second diode with said second diode connected to said second transistor in the same manner as said first diode and said first transistor, the emitter of said second transistor being connected to the common of said voltage supply the electrode of said second diode not connected to said second transistor being connected to the emitter of said first transistor the entire combination comprising four elements in series between said voltage source and said voltage source common;

a first transformer the primary winding of which is connected to the emitter of said first transistor;

a second transformer the primary winding of which is connected in series with the primary winding of said first transformer, the other end of said primary winding being connected to a load to receive the alternating current and voltage provided by the alternate switching on and off of said first and second transistors;

a first secondary on said first transformer connected between the base and emitter of said first transistor and polarized such that current flowing through said first transistor and the primary of said first transformer to the load will drive said first secondary in such a manner as to provide base current to said first transistor;

a first secondary of said second transformer connected between the base and the emitter of said second transistor polarized in such a manner as to provide drive current to said second transistor when current is flowing from the load through said primary of said second and first transformers, said second diode and said second transistor collector and emitter junction the turns ratio maintained between said first transformer's primary and first secondary, and said second transformer's primary and first secondary to be maintained equal to the minimum gain of said first and second transistors;

one or more first capacitors connected to the other end of said load and the common line of said DC power source, to the DC power source itself, or both, the capacitive reactance thus established eliminating any direct current component flowing in said load;

a second secondary on said first transformer and a third secondary on said second transformer, the same end of each connected together and connected to a capacitor whose other end is connected to the common of said voltage supply, third and fourth transistors the collectors of each connected to one of the other ends of the said second secondaries;

a second and fourth diode each connected across said third and fourth transistors between collector and emitter polarized to conduct current in the opposite direction that current is conducted when said third and fourth transistors are in the on state;

said second secondaries of said first and second transformers being polarized to force said first and second transistors off when said third and fourth transistors are in the on conducting condition;

a variable frequency oscillator with two outputs, one output connected to drive said third transistor, the second output connected to drive said fourth transistor. Each output causing the on conduction of its appropriate third or fourth transistor, at the beginning of each half cycle alternately for a predetermined time period;

a method to adjust the frequency of said variable frequency oscillators.

2. The invention as defined in claim 1 wherein:

the power to drive the variable frequency oscillator is derived from the junction of said third secondaries of said first and second transformer and said second capacitor.

3. The invention as defined in claim 1 wherein:

a method of driving an inductive load comprising a third secondary on said first transformer connected between the input to said load where the primary of said third transformer is connected and a fifth diode whose other end is connected to the source of DC voltage, said fifth diode polarized to conduct current when the voltage at the input to the load rises above the source of DC voltage, the polarity of said third secondary of said first transformer connected to cause said first secondary to drive said first transistor on when current is conducted through said fifth diode;

a third second secondary on said second transformer connected to the input of the load at the same place as the third secondary of said first transformer, the other end of said third secondary of said second transformer connected to a sixth diode, the other electrode of which is connected to the common of the DC voltage source, said sixth diode being polarized to conduct current when the voltage at the input to the load drops below said DC voltage source common, the polarity of said third secondary of said second transformer adjusted such that when said sixth diode is conducting, said second transistor is driven on by the first secondary of said second transformer;

4. The invention as defined in claim 1 wherein:

the source of DC voltage comprises a source of alternating current and voltage, each of the supply and return lines for the AC voltage and current connected to two windings of a magnetic element, the other ends of each winding respectively connected to the AC inputs of a conventional bridge rectifier; a first capacitor connected between the positive and negative outputs of said bridge rectifier;

a third winding on said magnetic element connected in series with either output of said bridge rectifier; a second capacitor connected between the output not connected to said third winding of said bridge rectifier and the other end of said third winding, the voltage across said second capacitor to be the source of the DC voltage first specified;

said magnetic element to have three parallel magnetic core elements connected on each end with a continuous magnetic flux path such that the flux from each element will be returned through the combination of the other two elements, said first and second windings to be wound on the two outermost of the three elements and said third coil to be wound on the center element.

5. The invention is defined in claim 1 wherein:

a starting circuit is incorporated utilizing a diac connected between the base of said first transistor and a third capacitor, the other end of which is connected to the emitter of said first transistor;

a first resistor connected to the source of DC voltage and the junction of said diac and said third capacitor to charge said third capacitor to the point where said diac will trigger a second resistor connected from the other end of said third capacitor, and the common of said DC voltage source to supply a current return path for the charging current supplied by said first resistor, a seventh diode, connected in parallel with said first resistor polarized to conduct current in the opposite direction as the charging current supplied by said first resistor such that any charge on said third capacitor will be discharged any time said first transistor is in the on conducting state preventing the operation of the starting circuit once the circuit has commenced to operate.

6. The invention as defined in claim 5 wherein:

an additional means shall be included to drive an inductive load comprising;

a seventh and eighth pair of diodes connected in series between said DC voltage source and said common for said DC voltage source polarized to conduct current in the opposite direction as said first and second transistors;

a fourth secondary on said transformer connected to the junction of said seventh and eighth diodes and the input to said load, polarized to cause said first transistor to be driven on when current is flowing through said seventh diode and said second transistor to be driven on when current is flowing through said eighth diode;

a source of DC voltage comprising a source of alternating current voltage, each of the supply and return lines for the AC voltage and current connected to two windings of a magnetic element, the other ends of each winding respectively connected to the AC inputs of a conventional bridge rectifier; a first capacitor connected between the positive and negative outputs of said bridge rectifier;

a third winding on said magnetic element connected in series with either output of said bridge rectifier; a second capacitor connected between the output not connected to said third winding of said bridge rectifier and the other end of said third winding, the voltage across said second capacitor to be the source of the DC voltage first specified;

said magnetic element to have three parallel magnetic core elements connected on each end with a continuous magnetic flux path such that the flux from each element will be returned through the combination of the other two elements, said first and second windings to be wound on the two outermost of the three elements and said third coil to be wound on the center element.

7. The invention as defined in claim 5 wherein:

said load comprises a first inductor and a second capacitor connected as a series resonant circuit through the first capacitor DC isolation means to the output of said bridge inverter;

an isolation transformer the primary of which is connected directly across said second capacitor;

the secondary of said isolation transformer being connected directly across a gas discharge device.

8. The invention as described in claim 7 wherein:

a heater transformer the primary of which is connected directly across the secondary of said isolation transformer through a parallel resonant circuit comprising a second induction and a third capacitor connected in parallel and their in series with the primary of said heater transformer;

said heater transformer secondaries of adequate number to supply the number of heaters required in said gas discharge load.

9. The invention as described in claim 8 wherein:

a sensing resistor is adding in series with the gas discharge load across said isolation transformer such that the current through said gas discharge load will be represented as a voltage drop across said sensing resistor to determine load current.

10. The circuit as described in claim 9 wherein:

a second resistor is placed in series with the primary of said heater transformer such that the voltage across said second resistor will represent the current passing through said primary;

a logic circuit which receives the signal from said second resistor to indicate the heater current flowing, the voltage from said first resistor indicating the current flowing in the load the voltage across one of the windings of said heater transformer indicating the amount of voltage being applied to said heaters and an intensity control input;

an output from said logic circuit logically responsive to all of said inputs to adjust the frequency in the variable frequency oscillator thus controlling the power delivered to the heaters and the load.

11. The invention as defined in claim 10 wherein:

the logic circuit and variable frequency oscillator are implemented as follows;

a conventional inverter oscillator chip with two oppositely polarized outputs and a five volt regulator employing an external resistor and capacitor to determine the operating frequency;

the resistor that determines the operating frequency connected to common through a fifth capacitor such that as charge accumulates on said capacitor, the frequency will decrease;

a pair of voltage comparitors whose outputs are connected together and to a resistor which acts to remove the charge from said capacitor whenever either output goes low;

the oppositely polarized outputs of said oscillator chip being connected as previously described in claim 5;

the output of the second secondary on said isolation transformer being rectified by a diode and filtered by a capacitor to supply energy to said oscillator and regulator chip as well as to power the two comparitors;

this same output fed through a voltage adjusting resistor string and diode to the negative input of the first comparitor such that should this voltage go too high, said comparitors output would be driven low removing charge from said fifth capacitor causing the frequency of said oscillator to increase detuning the resonant circuit comprised of said inductor and said second capacitor and lowering the voltage to the primary said isolation transformer thus providing a feedback loop, the reference voltage supplied to the first comparitor is derived from a resistor string connected between the five volt regulated output of the oscillator regulator chip and the circuit common;

a second diode coupled input to the negative junction of said voltage comparitor derived from the voltage drop across the sense resistor connected in series with the primary of said heater transformer such that should the current flowing to the heaters become too high the voltage will drive the output of said first comparitor low increasing the frequency and reducing the voltage;

a third input to the minus junction of said first comparative diode from a resistor strain connected to the output of the heater transformer closest to the common such that should the heater voltage become too high, the frequency will be raised reducing the voltage;

an input to the negative junction of the second comparitor from the voltage drop across the resistor carrying the tube current, said voltage drop being proportional to said tube current via a rectifying diode and a resistor string to produce the appropriate level, the positive comparitor junction of said comparitor being connected to a potentiometer which comprises a portion of a resistor string connected between the five volt regulated reference voltage and the circuit common, when the potentiomenter is adjusted, it determines the amount of current that may flow in the tube before the output of said second comparitor is driven low preventing the frequency from decreasing and the tube current from increasing. The adjustment of said potentiometer therefore, determines the amount of tube current and thus the intensity of the light emitted;

said resistor string containing said potentiometer split up in such a manner that the voltage drop across said potentiometer may be changed by partially shorting either momentarily or gradually some of the current of the resistor string around said potentiometer and reducing the voltage drop there across causing a dimming action which would be equivalent to the adjustment of the potentiometer;

a capacitor connected from the high end of said potentiometer to the circuit common to eliminate any noise that might enter the circuit through external control just described.

12. A source of DC voltage;

a first transistor and a first diode connected in series such that said voltage source is applied to the collector of said first transistor through said first diode which is forward biased to conduct current through said first diode at the same time it is passing through said first transistor;

a second transistor and a second diode with said second diode connected to said second transistor in the same manner as said first diode and said first transistor, the emitter of said second transistor being connected to the common of said voltage supply, the electrode of said second diode not connected to said second transistor being connected to the emitter of said first transistor, the entire combination comprising four elements in series between said voltage source and said voltage source common;

a transformer whose primary is operably connected between the emitter of said first transistor and the input to a series string comprising a load into which power is delivered and a first capacitor or set of capacitors which return the current delivered to said load either to the source of DC voltage or the common of said source or both;

a first secondary on said transformer connected between the emitter and base of said first transistor polarized to drive said first transistor on when current is flowing in said first transistor and primary of said transformer;

a second secondary on said transformer connected between the base and emitter of said second transistor polarized to drive said second transistor on when current is flowing through said second transistor and the primary of said transformer;

a third secondary of said transformer connected between the oppositely polarized outputs of a variable frequency oscillator via a third and fourth diode connecting each end of said third secondary to its respective output, a fifth and sixth diode each connected, one to one end of said third secondary, the other to the other end of third secondary, both terminated on the common of said DC voltage source, diodes three through six polarized such that when the appropriate output of said variable frequency oscillator is conducted to ground said third secondary is effectively shorted for current flowing in that direction. Alternatively, when the oppositely polarized output of said variable frequency oscillator is conducted to ground, said third secondary is again shorted for current flowing in the opposite direction;

a method to adjust the frequency of the variable frequency oscillator.

* * * * *